US005704853A

United States Patent [19]

Maruko et al.

[11] Patent Number: 5,704,853

[45] Date of Patent: Jan. 6, 1998

[54] THREAD-WOUND GOLF BALLS

[75] Inventors: Takashi Maruko; Junji Hayashi; Shinichi Kakiuchi, all of Saitama, Japan

[73] Assignee: Bridgestone Sports Co., Ltd., Tokyo, Japan

[21] Appl. No.: 643,353

[22] Filed: May 6, 1996

[30] Foreign Application Priority Data

May 29, 1995 [JP] Japan ..... 7-153901

[51] Int. Cl.[6] ..... A63B 37/06; A63B 37/12; A63B 37/14

[52] U.S. Cl. ..... 473/363; 473/351; 473/365; 473/383

[58] Field of Search ..... 473/356, 357, 473/361, 363, 365, 370, 378, 384, 351

[56] References Cited

U.S. PATENT DOCUMENTS 5,445,387 8/1995 Maruko et al. ..... 473/363

5,467,994 11/1995 Moriyama et al. ..... 473/365 X 5,470,075 11/1995 Nesbitt et al. ..... 473/384 X

*Primary Examiner*—George J. Marlo

*Attorney, Agent, or Firm*—Sughrue, Mion, Zinn, Macpeak & Seas

[57] ABSTRACT

The present invention provides a thread-wound golf ball comprising a thread rubber ball prepared by winding thread rubber around a spherical solid center, and a cover enclosing the thread rubber ball therewith, which has a number of dimples of from 350 to 500 and a dimple volume rate of 0.76 to 0.9 percent, and wherein the solid center has an outer diameter of from 27 to 38 mm, a deformation under a load of 30 Kg of from 1.5 to 3.5 mm and a rebound, when dropped from a height of 120 cm, of at least 96 cm. The thread-wound golf balls of the present invention show good spin properties in addition to good restitution properties, resulting in improved travel distance.

10 Claims, 1 Drawing Sheet

THREAD-WOUND GOLF BALLS

BACKGROUND OF THE INVENTION

1. Field of the Invention

The present invention relates to a thread-wound golf ball using a solid center, and more particularly to the technology to improve travel distance of the thread-wound golf ball.

2. Related Art

Thread-wound golf balls are prepared by winding thread rubber around a center to form a thread rubber ball, and then enclosing the thread rubber ball with a cover. There are two types of centers, i.e., a liquid center and a solid center. The liquid center is prepared by enclosing a liquid in a spherical rubber bag, whereas the solid center is prepared by molding synthetic rubber into spherical shape.

Thread-wound golf balls are advantageous in soft feel on impact and excellent spin properties (easy to impart spin) as compared to a two-piece ball, and thus are preferred by a skilled golf player. The thread-wound golf balls are, however, disadvantageous in travel distance as compared to a two-piece ball. In this case, thread-wound golf balls with a solid center are advantageous in travel distance owing to large coefficient of restitution, as compared to those with a liquid center. However, further improvement in travel distance is still desired.

On the other hand, heretofore, there have been made several proposals regarding improvement in travel distance in the thread-wound golf balls with a solid center. For example, the thread-wound golf balls as described in the following items ① to ④ are known.

① A thread-wound golf ball prepared by winding a rubber thread on a high elastic solid center having a diameter of from 33 to 38 mm and a JIS-C hardness of from 65 to 90 so as to make the rubber thread layer to have a thickness of from 1 to 2.5 mm (Kokai S60-72573).

② A thread-wound golf ball having a diameter of at least 41.148 mm and a weight of not more than 45.92 g, which comprises a solid center having a diameter of from 30 to 38 mm, a specific gravity of not more than 1.10 and a compression strength, as amount of deformation, of from 1.0 to 2.0 mm, and a thread rubber ball having a weight of not more than 34 g (Kokai S59-129072).

③ A thread-wound golf ball, when having a diameter of 1.62 inch, comprising a solid center having an outer diameter of from 27 to 30 mm, a JIS-A hardness of from 75 to 85 and a weight of from 20.5 to 23.5 g. When having a diameter of 1.68 inch, the ball comprises a solid center having an outer diameter of from 28 to 32 mm, a JIS-A hardness of from 70 to 80 and a weight of from 17.5 to 21.0 g; and a cover made of an ionomer resin having a softening point of at least 50° C., and having a hardness of at least 65 on the Shore D scale and a thickness of from 1.5 to 2.0 mm (Kokai S60-168471).

④ A thread-wound golf ball comprising a solid center formed of a cross-linked rubber component having an oily substance therein, and having a restitution elasticity of at least 90 cm (Kokai H05-337217).

In the proposals to improve travel distance in the conventional thread-wound golf balls with a solid center, there have been determined preferable properties of the solid center such as outer diameter, hardness, specific gravity and restitution properties, and preferable hardness of the cover in addition to the properties of the solid center. However, other factors relating to travel distance of a golf ball, such as characteristics of a dimple have not been considered.

SUMMARY OF THE INVENTION

The present invention was made in view of the above-mentioned situations. Thus, it is an object of the present invention to generally and comprehensively investigate factors relating to improvement of travel distance of a thread-wound golf ball with a solid center, to provide a thread-wound golf ball having improved restitution properties and spin properties, resulting in improved travel distance.

In order to achieve the above object, the present inventors have studied several factors relating to travel distance of a thread-wound golf ball with a solid center. As a result, it was found that the restitution properties and spin properties of the thread-wound golf ball can be improved when certain five factors are set within specific ranges. Such five factors are outer diameter, hardness (amount of deformation under a load of 30 Kg) and restitution properties (rebound when dropped from a height of 120 cm) of the solid center; and number of dimples and dimple volume rate of the resulting golf ball.

In other words, the present inventors found that combination of the following four technical items can improve restitution properties and spin properties of a thread-wound golf ball with a solid center, resulting in increase in travel distance. The present invention was made based on these findings.

1. To make the solid center to have a large diameter, i.e., an outer diameter of from 27 to 38 mm, to decrease spin quantity of a golf ball when hit.
2. To make the solid center have increased hardness, i.e., a deformation under a load of 30 Kg of from 1.5 to 3.5 mm, to decrease elongation rate of a rubber thread, resulting in good feel on impact.
3. To make the solid center to have higher coefficient of restitution, i.e., a rebound, when dropped from a height of 120 cm, of at least 96 cm, to improve restitution properties of the resulting golf ball.
4. To make the resulting golf ball to have smaller dimple volume rate, i.e., a number of dimples of from 350 to 500 and a dimple volume rate of from 0.76 to 0.9 percent, to make the resulting golf ball to fly in higher travel route.

According to the present invention, there is provided a thread-wound golf ball comprising a thread rubber ball prepared by winding thread rubber around a spherical solid center, and a cover enclosing the thread rubber ball therewith, which has a number of dimples of from 350 to 500 and a dimple volume rate of 0.76 to 0.9 percent, and wherein the solid center has an outer diameter of from 27 to 38 mm, a deformation under a load of 30 Kg of from 1.5 to 3.5 mm and a rebound, when dropped from a height of 120 cm, of at least 96 cm.

In the present invention, the solid center may preferably have an outer diameter of from 28 to 35 mm, a deformation under a load of 30 kg of from 1.7 to 2.5 mm, and a rebound of from 98 to 110 cm, and more preferably have an outer diameter of from 30 to 33 mm, a deformation under a load of 30 kg of from 1.8 to 2.2 mm, and a rebound of from 100 to 110 cm. Preferably, the number of dimples is in the range of from 370 to 480. The dimple volume rate may preferably be in the range of from 0.78 to 0.88 percent. The solid center may be made of vulcanized rubber prepared from polybutadiene rubber or a blend of polybutadiene rubber and polyisoprene rubber. Further, the cover may be made of an ionomer resin or balata in the form of a single layer or a multiple layer. The single layer cover may have a hardness on the Shore D scale of from 40 to 68, and a thickness of from 1.0 to 2.5 mm. The multi-layer cover may comprise an outer cover formed of a resin having a hardness on the Shore D scale of from 40 to 55, and an inner cover formed of a resin having a hardness on the Shore D scale of from 55 to 68.

The thread-wound golf balls of the present invention show good spin properties in addition to good restitution properties, resulting in improved travel distance.

PREFERRED EMBODIMENTS OF THE INVENTION

Figure 1:
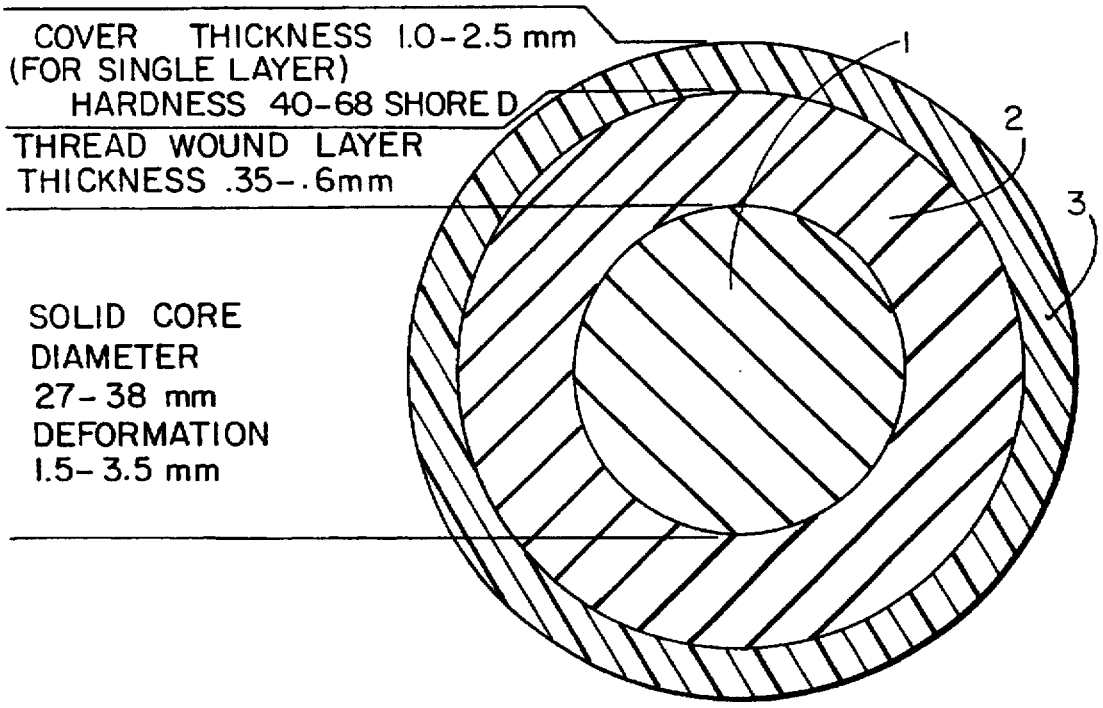
FIG. 1 is a cross-sectional view of the golf ball in accordance with this invention.

The present invention will be described in more detail below and with reference to FIG. 1.

In the present invention, the solid center 1 has an outer diameter of from 27 to 38 mm. When the outer diameter is less than 27 mm, the low spin, when hit, of the resulting golf ball cannot be obtained, resulting in short travel distance. When the outer diameter exceeds 38 mm, sufficient amount of a rubber thread cannot be wound on the solid center. In this case, unless the solid center is made remarkably hard or the elongation rate of the rubber thread is made remarkably high, a resulting golf ball with reasonable hardness cannot be obtained. Even if reasonable hardness is obtained in this way, the resulting golf ball may have poor durability and unsatisfactory feel on impact. The solid center may preferably have an outer diameter of from 28 to 35 mm, more preferably from 30 to 33 mm.

The solid center used in the present invention has a deformation under a load of 30 Kg of from 1.5 to 3.5 mm. The deformation under a load of 30 Kg means amount of deformation (mm) under a load of 30 Kg applied to the solid center, with the amount of deformation under an initial load of 1 Kg being fixed as 0 mm. When the deformation under a load of 30 Kg is less than 1.5 mm (the center is hard), the restitution properties (rebound) of the solid center may become poor, resulting in decrease in the restitution properties of the resulting golf ball, and increase in spin quantity thereof. Thus, the resulting golf ball may give short travel distance. When the deformation under a load of 30 Kg exceeds 3.5 mm (the center is soft), a golf ball with reasonable hardness may not be obtained unless the elongation rate of the rubber thread is increased. When trying to obtain the golf balls with reasonable hardness in this way, thread cut rate, when wound, is increased, and the resulting ball may have poor durability. The solid center may preferably have a deformation under a load of 30 kg of from 1.7 to 2.5 mm, particularly 1.8 to 2.2 mm. When the deformation exceeds 2.5 mm, there is a possibility that the center is deformed in a thread-winding step unless the center is frozen.

The solid center used in the present invention has a rebound, when dropped from a height of 120 cm high, of at least 96 cm. As used herein, the "rebound" means rebound height (maximum height) of a ball when a solid center is naturally dropped perpendicularly from a height of 120 cm onto a steel pillar having a diameter of 10 cm and a height of 10 cm. When the rebound is less than 96 cm, the restitution properties of the resulting golf ball will be lowered, resulting in decrease in travel distance. The rebound is preferably in the range of from 98 to 110 cm, particularly from 100 to 110 cm.

Further, the golf ball of the present invention has a number of dimples of from 350 to 500. When the number of dimples is less than 350, the diameter of each dimple will become large, resulting in decrease in degree of sphericity of the resulting golf ball. When the number of dimples exceeds 500, the diameter of each dimple will become so small so that appropriate effects of the dimples cannot be obtained. The number of dimples may preferably be in the range of from 370 to 480, particularly 390 to 450.

Further, the golf balls of the present invention have a dimple volume rate of from 0.76 to 0.9 percent. The dimple volume rate is a value calculated by the following formula. In the following formula, the ball volume is the volume of a true spherical ball assuming that there are no dimples; and the dimple total volume is the sum of the volume of each dimple.

$$\text{Dimple Volume Rate (\%)} = (\text{Dimple Total Volume}/\text{Ball Volume}) \times 100$$

When the dimple volume rate is less than 0.76 percent, the travel distance may be reduced since the travel route will become higher. When the dimple volume rate exceeds 0.9 percent, the travel distance may be reduced due to low travel route. More preferable range of the dimple volume rate may be from 0.78 to 0.88 percent, particularly from 0.80 to 0.86 percent.

In addition, when the outer diameter of the golf ball is 42.67 mm, a dimple volume rate of 0.75 percent gives a dimple total volume of 305 $mm^3$; a dimple volume rate of 0.80 percent gives a dimple total volume of 325 $mm^3$; a dimple volume rate of 0.85 percent gives a dimple total volume of 346 $mm^3$; a dimple volume rate of 0.90 percent gives a 366 $mm^3$; and a dimple volume rate of 1.00 percent gives a dimple total volume of 407 $mm^3$.

The materials of the solid center used in the present invention are not particularly limited to, but may include vulcanized rubber. In this case, suitable base rubber may include, for example, polybutadiene rubber or a blend of polybutadiene rubber and polyisoprene rubber. To obtain good restitution properties, particularly preferred is 1,4-polybutadiene rubber having at least 90 percent of cis-configuration. In addition, to make a solid center to have high coefficient of restitution, it is preferable not to add natural rubber. The solid center made of vulcanized rubber may be prepared by adding, to the above base rubber, an additive such as a vulcanizing agent (cross-linker), vulcanization accelerator, accelerator aid, activating agent, filler, modifier or anti-oxidant as desired, and then subjecting the obtained mixture to vulcanization and molding.

When using an organic peroxide and cocross-linker in vulcanization and molding of the solid center, suitable organic peroxide may include, for example, dicumyl peroxide and a blend of dicumyl peroxide and 1,1-bis(t-butylperoxy)-3,3,5-trimethylcyclohexane. The amount of organic peroxide used may usually range from 0.5 to 1.5 parts by weight based on 100 parts by weight of the base rubber. Further, suitable cocross-linker may include, for example, zinc salts or magnesium salts of unsaturated fatty acids such as methacrylic acid or acrylic acid, and esters such as trimethylpropane trimethacrylate. To obtain a high coefficient of restitution, zinc acrylate is particularly preferred. The amount of cocross-linker used may usually range from 10 to 30 parts by weight based on 100 parts by weight of the base rubber.

The thread-wound golf balls of the present invention may be prepared by winding thread rubber 2 around the above-mentioned solid center 1 to form a thread rubber ball, and then enclosing the thread rubber ball with a cover 3, and at the same time forming the above-mentioned dimples. In this case, the material and the type of the thread rubber and the cover, and the outer diameter and the weight of the thread rubber ball and the resulting golf ball, can be appropriately selected. Further, a method for producing the thread-wound golf balls of the present invention is not particularly limited to, but includes, for example, a method comprising forming a thread rubber ball, and enclosing the thread rubber ball with a single-layer or multi-layer cover by compression molding or injection molding.

The thread rubber may include, for example, those prepared by subjecting natural rubber, or a blend of natural rubber and polyisoprene rubber to vulcanization and molding. In the present invention, the hardness of the solid center is made high and the resulting ball may have reasonable hardness without making the elongation rate, after wound, of the rubber thread high. Thus, the feel on impact can be improved by keeping the elongation rate of the rubber thread low. More specifically, it is preferable to make the rubber thread to have an elongation rate of from 7 to 9 times. In addition, the thickness of the rubber thread layer may preferably range from 0.35 to 0.60 mm.

In the preparation of the thread-wound golf balls, in general, dimples are formed on the surface of the cover at the same time or after the cover is coated on the thread rubber ball. The geometrical configuration of the dimples are in any desired form such as octahedron or icosahedron, and the dimple design may be in any form such as square, hexagon or triangle.

The cover may be made of an ionomer resin, balata or the like, in the form of a single layer or a multiple layer. When using a single-layer cover, the cover may preferably have a hardness on the Shore D scale of from 40 to 68, and a thickness of from 1.0 to 2.5 mm.

Further, in the thread-wound golf balls of the present invention, the cover may be a multi-layer cover consisting of an outer cover and an inner cover having hardness greater than that of the outer cover. This improves feel on impact and cut resistance.

In this case, hard inner cover may be formed of a resin having a hardness on the Shore D scale of from 55 to 68, particularly from 60 to 66. More specifically, the inner cover may be formed of an ionomer resin produced by DuPont-Mitsui Polychemical Co., Ltd. such as Himilan 1554, 1555, 1601, 1702, 1705 or 1706, or a blend of two or more of these resins.

The soft outer cover may be formed of a resin having a hardness on the Shore D scale of from 40 to 55, particularly from 45 to 51. More specifically, the outer cover may be formed of an ionomer resin produced by E.I. DuPont such as Surlyn 8120, 8220 or 8320, a blend of two or more of these resins, balata, or the like. In addition, the difference in hardness between the inner and outer covers may be at least 5, particularly at least 10 on the Shore D scale.

In the multi-layer cover, the inner cover may preferably have a thickness of from 0.4 to 3.0 mm, particularly from 0.6 to 2.0 mm. When the thickness is less than 0.4 mm, the cut resistance of the ball, when hit in its top portion, may be lowered. When the thickness is more than 3.0 mm, it may become difficult to obtain good initial velocity. The outer cover may preferably have a thickness of from 0.4 to 3.0 mm, particularly from 0.6 to 2.0 mm. When the thickness is less than 0.4 mm, there may be a tendency that sufficient spin properties cannot be obtained for an approach shot. When the thickness is more than 3.0 mm, the travel distance may be decreased due to poor restitution properties.

Further, the total thickness of the inner cover and the outer cover may preferably be from 1.0 to 4.0 mm, particularly from 1.5 to 2.5 mm. When the total thickness is less than 1.0 mm, it may become difficult to obtain good durability of the ball, when hit in its top portion. When the total thickness is more than 4.0 mm, it may become difficult to obtain appropriate initial velocity. The ratio of thickness of an inner cover to that of an outer cover may preferably range from 3:7 to 7:3. When the outer cover is thinner outside of this range, the spin properties on approach shot may be lowered. When the outer cover is thicker outside of this range, the travel distance may become short.

The thread-wound golf balls of the present invention may be complied with the golf rules in their size and weight, and may be formed to have a diameter of at least 42.67 mm and a weight of not greater than 45.92 g. In addition, preferably the golf balls may have a deformation under a load of 100 Kg of from 2.6 to 3.6 mm in view of feel on impact, restitution properties and durability.

EXAMPLES AND COMPARATIVE EXAMPLES

The present invention will be described in more detail with reference to the following Examples and Comparative Examples which do not restrict the present invention.

Examples 1 to 7 and Comparative Examples 1 to 6

First, Solid Centers A to F as shown in Table 1 were prepared. These solid centers were prepared by subjecting rubber compositions as shown in Table 1 to vulcanization at 155° C. for 15 minutes. The results of measurement of the outer diameter, weight, hardness and rebound of the solid centers are shown. The hardness was determined by amount of deformation under a load of 30 Kg applied to the solid center, with the amount of deformation under an initial load of 1 Kg being fixed as 0 mm. The "rebound" means rebound height (maximum height) of a ball when a solid center is naturally dropped perpendicularly from a height of 120 cm on a steel pillar having a diameter of 10 cm and a height of 10 cm at 23° C.

Next, thread-wound golf balls prepared in the Examples and Comparative Examples as shown in Tables 3 and 4, were prepared by winding a rubber thread on the above-mentioned solid center to form a thread rubber ball, coating a cover on the thread rubber ball by compression molding. As the cover resin, the formulations shown in Table 2 was used, to prepare golf balls with a single-layer cover or a multi-layer cover. The properties of the covers and the resulting golf balls are as shown in Tables 3 and 4. The cover resins used to form a single-layer cover are indicated in the column for the outer cover resins. Further, the cover thickness ratio represents a thickness ratio of inner cover to outer cover. The hardness of the golf balls was determined by amount of deformation under a load of 100 Kg applied to a resulting golf ball (amount of distortion under a load of 100 Kg), with the amount of deformation under an initial load of 1 Kg being fixed as 0 mm.

In addition, the number of dimples of all the golf balls was set as 396. In this case, dimples having 4 different diameters were used, and the same dimple configuration was used in all the golf balls. Then, depth of the dimples was changed to prepare golf balls having 4 different dimple volume rate (0.75%, 0.80%, 0.86% and 0.91%).

The thread-wound golf balls prepared in the Examples and Comparative Examples were subjected to distance test. In the distance test, using a shooting test machine, the balls were hit by a No. 1 Wood at a head speed of 45 m/s, to measure initial velocity, spin quantity, launch angel, carry travel distance and total travel distance.

The results are as shown in Tables 3 and 4. As a result, it was found that the thread-wound golf balls prepared in the Examples showed good restitution properties, spin properties and large travel distance. On the contrary to this, it was found that the thread-wound golf balls prepared in the Comparative Examples were disadvantageous in travel route, restitution properties and spin properties, resulting in poor travel distance.

TABLE 1

| | Solid Centers | | | | | |
|---|---|---|---|---|---|---|
| | A | B | C | D | E | F |
| Formulation (p.b.w.) | | | | | | |
| Polybutadiene Rubber | 100 | 100 | 100 | 80 | 100 | 100 |
| Natural Rubber | | | | 20 | | |
| Zinc Acrylate | 20 | 10 | 25 | 22 | 30 | 10 |
| Zinc Oxide | 10 | 10 | 20 | 10 | 10 | 55 |
| Barium Sulfate | 58 | 61 | 21 | 60 | 55 | 100 |
| Stearic Acid | 1 | 1 | 1 | 1 | 1 | |
| Dicumyl Peroxide | 1.2 | 1.2 | 1.2 | 1.2 | 1.2 | 1.2 |
| Results of Measurement | | | | | | |
| Outer Diameter (mm) | 31.5 | 31.5 | 35.3 | 31.5 | 31.5 | 26.0 |
| Weight (g) | 23.0 | 23.1 | 29.3 | 23.0 | 23.0 | 16.6 |
| Hardness (mm) *1 | 1.9 | 3.1 | 1.7 | 2.0 | 1.1 | 2.9 |
| Rebound (cm) *2 | 98.0 | 103.0 | 98.0 | 94.5 | 95.0 | 96.5 |

*1: The deformation under a load of 30 kg.
*2: The rebound when dropped from a height of 120 cm.

TABLE 2

| | Cover Resins | | |
|---|---|---|---|
| Formulation (p.b.w.) | | | |
| Himilan 1557 | 25 | | |
| Surlyn 8120 | 50 | | |
| Surlyn 8320 | | 65 | |
| Himilan 1605 | | | 50 |
| Himilan 1650 | | 35 | |
| Himilan 1706 | | | 50 |
| Himilan 1856 | | 25 | |
| Shore D Hardness | 51 | 47 | 64 |

TABLE 3

| | Examples | | | | | | |
|---|---|---|---|---|---|---|---|
| | 1 | 2 | 3 | 4 | 5 | 6 | 7 |
| Center | | | | | | | |
| Kind | A | A | A | B | B | C | C |
| Outer Diameter (mm) | 31.5 | 31.5 | 31.5 | 31.5 | 31.5 | 35.3 | 35.3 |
| Hardness (mm) *1 | 1.9 | 1.9 | 1.9 | 3.1 | 3.1 | 1.7 | 1.7 |
| Rebound (cm) *2 | 98.0 | 98.0 | 98.0 | 103.0 | 103.0 | 98.0 | 98.0 |
| Cover | | | | | | | |
| Construction | Single Layer | Two Layers | Two Layers | Single Layer | Two Layers | Single Layer | Single Layer |
| Outer Cover Resin | Z | Y | Y | X | Y | Z | Z |
| Inner Cover Resin | — | Z | Z | — | Z | — | — |
| Total Thickness (mm) | 1.8 | 1.8 | 1.8 | 1.8 | 1.8 | 1.8 | 1.8 |
| Thickness Ratio | — | 5:5 | 5:5 | — | 5:5 | — | — |
| Dimple | | | | | | | |
| Dimple Number | 396 | 396 | 396 | 396 | 396 | 396 | 396 |
| Dimple Volume Ratio (%) | 0.80 | 0.86 | 0.80 | 0.80 | 0.80 | 0.80 | 0.86 |
| Golf Ball | | | | | | | |
| Weight (g) | 45.3 | 45.3 | 45.2 | 45.3 | 45.3 | 45.2 | 45.3 |
| Outer Diameter (mm) | 42.67 | 42.67 | 42.68 | 42.68 | 42.67 | 42.68 | 42.67 |
| Hardness (mm) *3 | 3.01 | 3.00 | 2.98 | 3.03 | 3.00 | 3.05 | 3.08 |
| Results of Distance Test | | | | | | | |
| Initial Velocity (m/s) | 65.5 | 65.3 | 65.3 | 65.3 | 65.6 | 65.5 | 65.4 |
| Spin Quantity (rpm) | 2750 | 2880 | 2900 | 2970 | 2850 | 2620 | 2650 |
| Launch Angle (degree) | 11.7 | 11.8 | 11.6 | 11.8 | 11.8 | 11.6 | 11.4 |
| Carry Travel Distance (m) | 210.5 | 211.8 | 211.0 | 209.2 | 211.5 | 210.0 | 208.4 |
| Total Travel Distance (m) | 230.2 | 227.1 | 228.3 | 225.9 | 229.5 | 231.2 | 228.7 |

*1: The deformation under a load of 30 kg.
*2: The rebound height of a ball when dropped from a height of 120 cm.
*3: The deformation under a load of 100 kg.

TABLE 4

| | Comparative Examples | | | | | |
|---|---|---|---|---|---|---|
| | 1 | 2 | 3 | 4 | 5 | 6 |
| Center | | | | | | |
| Kind | A | A | A | D | E | F |
| Outer Diameter (mm) | 31.5 | 31.5 | 31.5 | 31.5 | 31.5 | 26.0 |
| Hardness (mm) *1 | 1.9 | 1.9 | 1.9 | 2.0 | 1.1 | 2.9 |
| Rebound (cm) *2 | 98.0 | 98.0 | 98.0 | 94.5 | 95.0 | 96.5 |
| Cover | | | | | | |
| Construction | Single Layer | Two Layers | Single Layer | Single Layer | Single Layer | Single Layer |
| Outer Cover Resin | Z | Y | Z | Z | Z | Z |
| Inner Cover Resin | — | Z | — | — | — | — |
| Total Thickness (mm) | 1.8 | 1.8 | 1.8 | 1.8 | 1.8 | 1.8 |
| Thickness Ratio | — | 5:5 | — | — | — | — |
| Dimple | | | | | | |
| Dimple Number | 396 | 396 | 396 | 396 | 396 | 396 |
| Dimple Volume Ratio (%) | 0.91 | 0.91 | 0.75 | 0.80 | 0.80 | 0.80 |
| Golf Ball | | | | | | |
| Weight (g) | 45.3 | 453 | 45.2 | 45.3 | 453 | 45.2 |
| Outer Diameter (mm) | 42.68 | 42.68 | 42.68 | 42.67 | 42.67 | 42.68 |
| Hardness (mm) *3 | 3.00 | 3.02 | 2.97 | 3.00 | 2.98 | 3.04 |
| Results of Distance Test | | | | | | |
| Initial Velocity (m/s) | 65.5 | 65.3 | 65.5 | 65.0 | 65.1 | 65.5 |
| Spin Quantity (rpm) | 2780 | 2900 | 2750 | 2750 | 2850 | 3080 |
| Launch Angle | 11.3 | 11.4 | 12.2 | 11.4 | 11.5 | 12.0 |
| Carry Travel Distance (m) | 205.0 | 206.8 | 213.5 | 207.4 | 207.8 | 206.5 |
| Total Travel Distance (m) | 223.8 | 223.2 | 222.5 | 224.3 | 224.0 | 224.1 |

*1: The deformation under a load of 30 kg.
*2: The rebound height of a ball when dropped from a height of 120 cm.
*3: The deformation under a load of 100 kg.

We claim:

1. A thread-wound golf ball comprising a thread rubber ball prepared by winding thread rubber around a spherical solid center, and a cover enclosing the thread rubber ball therewith, which has a number of dimples of from 350 to 500 and a dimple volume rate of 0.76 to 0.9 percent, and wherein the solid center has an outer diameter of from 27 to 38 mm, a deformation under a load of 30 Kg of from 1.5 to 3.5 mm and a rebound, when dropped from a height of 120 cm, of at least 96 cm.

2. A thread-wound golf ball according to claim 1, wherein the solid center has an outer diameter of from 28 to 35 mm, a deformation under a load of 30 kg of from 1.7 to 2.5 mm, and a rebound of from 98 to 110 cm.

3. A thread-wound golf ball according to claim 2, wherein the solid center has an outer diameter of from 30 to 33 mm, a deformation under a load of 30 kg of from 1.8 to 2.2 mm, and a rebound of from 100 to 110 cm.

4. A thread-wound golf ball according to claim 1, wherein the number of dimples is in the range of from 370 to 480.

5. A thread-wound golf ball according to claim 1, wherein the dimple volume rate is in the range of from 0.78 to 0.88 percent.

6. A thread-wound golf ball according to claim 1, wherein the solid center is made of vulcanized rubber prepared from polybutadiene rubber or a blend of polybutadiene rubber and polyisoprene rubber.

7. A thread-wound golf ball according to claim 1, wherein the cover is made of an ionomer resin or balata in the form of a single layer or a multiple layer.

8. A thread-wound golf ball according to claim 7, wherein the cover is a single layer cover having a hardness on the Shore D scale of from 40 to 68, and a thickness of from 1.0 to 2.5 mm.

9. A thread-wound golf ball according to claim 7, wherein the cover is a multi-layer cover comprising an outer cover formed of a resin having a hardness on the Shore D scale of from 40 to 55, and an inner cover formed of a resin having a hardness on the Shore D scale of from 55 to 68.

10. A thread-wound golf ball according to claim 9, wherein the inner cover has a thickness of from 0.4 to 3.0 mm, and the total thickness of the inner cover and the outer cover is from 1.0 to 4.0 mm.

* * * * *